US008820892B2

(12) United States Patent
Saito et al.

(10) Patent No.: US 8,820,892 B2
(45) Date of Patent: Sep. 2, 2014

(54) INKJET PRINTING HEAD SUBSTRATE, INKJET PRINTING HEAD AND INKJET PRINTING APPARATUS

(75) Inventors: Akiko Saito, Tokyo (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 68 days.

(21) Appl. No.: 13/439,027

(22) Filed: Apr. 4, 2012

(65) Prior Publication Data

US 2012/0262521 A1 Oct. 18, 2012

(30) Foreign Application Priority Data

Apr. 15, 2011 (JP) ..... 2011-090854

(51) Int. Cl.

| | |
|---|---|
| ***B41J 2/05*** | (2006.01) |
| ***B41J 2/155*** | (2006.01) |
| ***B41J 2/16*** | (2006.01) |
| ***B41J 2/14*** | (2006.01) |

(52) U.S. Cl.

CPC ..... *B41J 2/155* (2013.01); *B41J 2202/20* (2013.01); *B41J 2/1603* (2013.01); *B41J 2/1628* (2013.01); *B41J 2/14145* (2013.01); *B41J 2002/14387* (2013.01); *B41J 2202/11* (2013.01)

USPC ..... 347/56; 347/63

(58) Field of Classification Search

USPC ..... 347/56

See application file for complete search history.

(56) References Cited

U.S. PATENT DOCUMENTS

| | | | | |
|---|---|---|---|---|
| 5,182,577 | A | 1/1993 | Ishinaga et al. | |
| 6,113,220 | A | 9/2000 | Ishinaga et al. | |
| 6,534,247 | B2 | 3/2003 | Milligan et al. | |
| 7,591,531 | B2 * | 9/2009 | Tsuchii et al. | 347/40 |
| 2009/0015635 | A1 * | 1/2009 | Tsukuda et al. | 347/44 |
| 2009/0273637 | A1 * | 11/2009 | Tsuchii et al. | 347/47 |
| 2010/0201754 | A1 | 8/2010 | Tsuchii et al. | |

* cited by examiner

*Primary Examiner* — Stephen Meier
*Assistant Examiner* — Renee I Wilson
(74) *Attorney, Agent, or Firm* — Fitzpatrick, Cella, Harper & Scinto

(57) ABSTRACT

Second etching is performed to the bottom through dry etching of a substrate to suppress image degradation even if an opening position of an ejection opening at a substrate end deviates. Provided is an inkjet printing head substrate including: a first surface, a second surface, and a plurality of ink supply openings, wherein the plurality of the heat resistive elements and the plurality of the ink supply openings are arranged in such a manner that each of distances between a heat resistive element closer to an inclined surface of the recessed portion in the inkjet printing head substrate among the plurality of the heat resistive elements and two ink supply openings adjacent to the heat resistive element is longer than each of distances between a heat resistive element closer to the center of the inkjet printing head substrate and two ink supply openings adjacent to the heat resistive element.

14 Claims, 10 Drawing Sheets

INKJET PRINTING HEAD SUBSTRATE, INKJET PRINTING HEAD AND INKJET PRINTING APPARATUS

BACKGROUND OF THE INVENTION

1. Field of the Invention

The present invention relates to an inkjet printing head substrate, an inkjet printing head and an inkjet printing apparatus, and particularly, to an inkjet printing head substrate, an inkjet printing head and an inkjet printing apparatus which form ink supply openings by dry etching.

2. Description of the Related Art

There is provided a method for manufacturing an inkjet printing head substrate, in which two-step etching processing is executed to a silicon substrate to form ink supply openings thereon. For example, there is known the technology in which first etching is performed onto the silicon substrate by wet etching to form a recessed portion, thus forming a liquid chamber thereon, and next, second etching is performed onto the bottom of the recessed portion by dry etching to form ink supply openings (for example, refer to U.S. Pat. No. 6,534,247).

In dry etching using Bosch process, a forming process of a deposited film, a removal process of the deposited film other than a side face by ions and an etching process by a radical are repeatedly executed to etch a silicon substrate. However, upon forming the ink supply opening by dry-etching the bottom of the recessed portion, since the plasma sheath is formed along the recessed portion, the ion for removing the deposited film is affected in the vicinity of the side wall in the recessed portion. Therefore, the deposited film in a position deviated from a desired position is possibly removed. In this manner, since the removal position of the deposited film continuously deviates on the substrate bottom having the recessed portion, the etching by the radial also is resultantly executed to continuously deviate. As a result, there is a possibility that the etching proceeds with an angle of several degrees. This event is not limited to a case of using Bosch process, but occurs in common to a case of using dry etching of general reactive ion etching (RIE).

As an example of the printing head substrate, there is a structure in which ink supply openings and heat resistive elements are alternately arrayed along the array direction of nozzles. When the structure is formed by the aforementioned etching method, there are some cases where an opening position of the ink supply opening at the substrate end positioned in the inclined surface side of the recessed portion deviates further in the end direction. As a result, it is found that there are some cases where the ink supply opening closer to the substrate end than the heat resistive element has a distance longer from the heat resistive element, and meanwhile, the ink supply opening closer to the center in the ejection opening row has a distance shorter from the heat resistive element. Since ink goes through the ink supply opening penetrating the substrate from a common liquid chamber and is filled into a pressure chamber, as a distance from an end of the ink supply opening to the heat resistive element in the pressure chamber is longer, the flow resistance to the ink is the larger. As a result, there occurs a flow resistance difference between the ink supply opening closer to the end of the substrate and the ink supply opening closer to the center of the substrate. Therefore, when pulse current is applied to the heat resistive element, the ink and the generate air bubbles move to be biased in a direction of the ink supply opening where the flow resistance is small, because of the flow resistance difference. As a result, ink droplets to be ejected result in being ejected to be inclined to the central direction of the ejection opening row.

Meanwhile, in the central section of the substrate, the ink supply opening is opened substantially perpendicularly. Therefore, the distance between the heat resistive element and the ink supply opening is constant and there occurs no resistance difference therebetween, so that ink droplets are ejected straight without occurrence of the bias of the bubble release in the development direction.

That is, the ejection opening close to the substrate end ejects ink droplets in a direction positioned in the substrate central section, and the ejection opening positioned in the substrate central section ejects ink droplets straight. Accordingly, since a landing position of the ink droplet by the ejection opening positioned at the substrate end deviates, there are some cases where image degradation occurs.

SUMMARY OF THE INVENTION

The present invention is made in view of the foregoing problem, and an object of the present invention is to provide an inkjet printing element which, even if an opening position of an ejection opening at a substrate end deviates, performs second etching onto the bottom in a recessed portion through dry etching of a substrate to suppress image gradation.

In order to achieve the above object, the present invention is provided with an inkjet printing head substrate including a first surface and a second surface, which is the backside of the first surface, on which a plurality of heat resistive elements are arrayed for ejecting ink, comprising a plurality of ink supply openings formed by dry-etching a recessed portion formed on the first surface of the inkjet printing head substrate to penetrate through the first surface and the second surface, the plurality of the ink supply openings being alternately arrayed one by one with the plurality of the heat resistive elements, wherein the plurality of the heat resistive elements and the plurality of the ink supply openings are arranged in such a manner that each of distances between a heat resistive element closer to an inclined surface of the recessed portion in the inkjet printing head substrate among the plurality of the heat resistive elements and two ink supply openings adjacent to the heat resistive element is longer than each of distances between a heat resistive element closer to the center of the inkjet printing head substrate and two ink supply openings adjacent to the heat resistive element.

According to the present construction, a rate in a flow resistance change from the end of the ink supply opening to the heat resistive element is made small. Therefore, even in a case where the opening position of the ink supply opening at the substrate end deviates, the bias of the ink droplet in the ejection direction can be suppressed.

Further features of the present invention will become apparent from the following description of exemplary embodiments (with reference to the attached drawings).

DESCRIPTION OF THE EMBODIMENTS

Hereinafter, embodiments in the present invention will be in detail explained with reference to the accompanying drawings.

(First Embodiment)

Figure 1A:
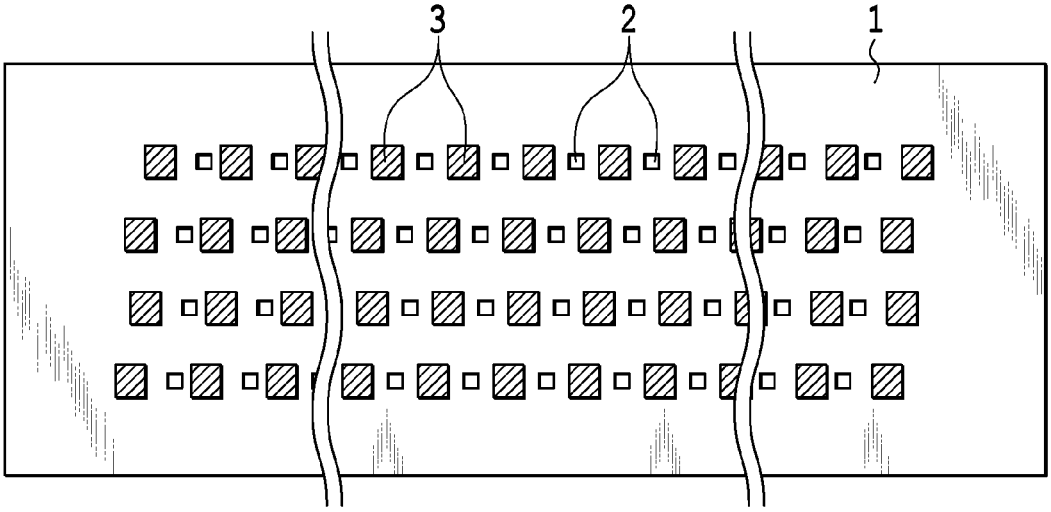
FIG. 1A and FIG. 1B are diagrams each showing a substrate according to a first embodiment.
Figure 1B:
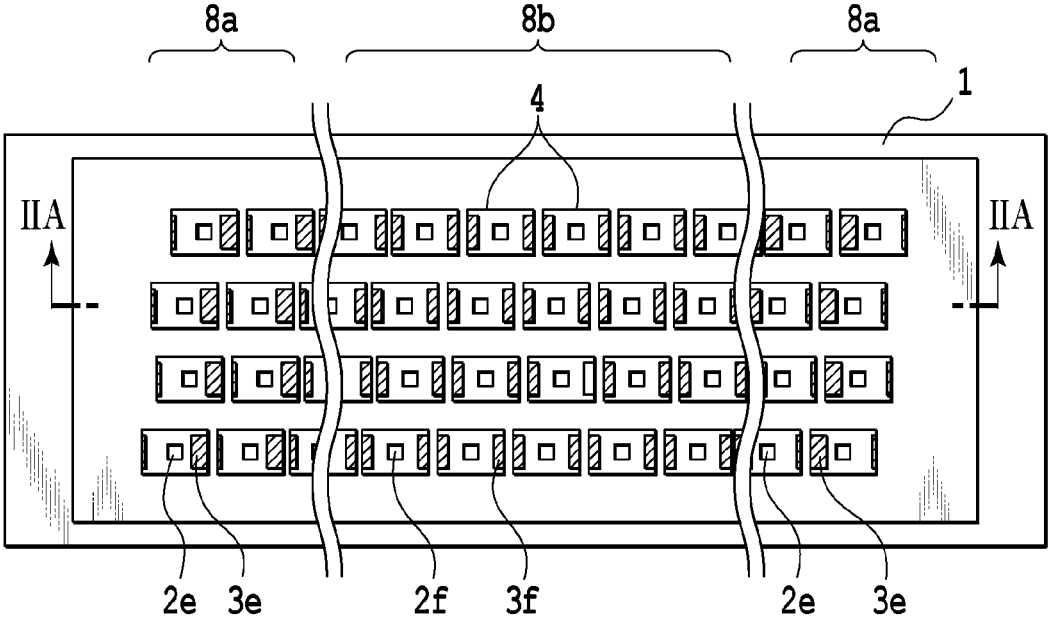

FIG. 1A and FIG. 1B are plan views each showing a surface of an inkjet printing head substrate in the present embodiment. FIG. 1A shows the surface of the substrate, and FIG. 1B shows the substrate with an orifice plate removed. FIG. 1A and FIG. 1B each show the substrate equipped with a first surface and a second surface which is the backside of the first surface. A plurality of heat resistive elements 2 are arrayed in the ejection opening row direction on the second surface. In addition, a plurality of ink supply openings 3 formed by dry etching to penetrate through the first surface and the second surface are arrayed respectively between the heat resistive elements to be adjacent to the heat resistive elements.

In the present embodiment, ejection openings positioned at an end of the substrate are defined as an ejection opening group 8*a*, and ejection openings positioned at the central section of the substrate are defined as an ejection opening group 8*b*.

Figure 2A:
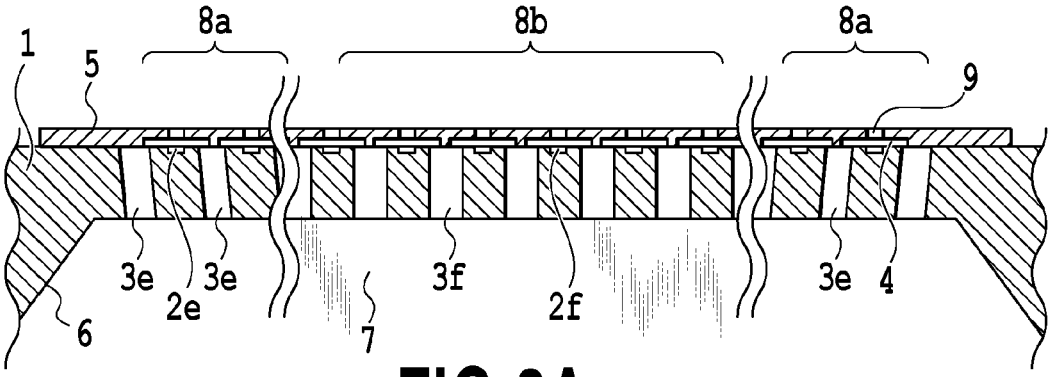
FIG. 2A to FIG. 2C are diagrams showing the substrate according to the first embodiment and a conventional substrate.
Figure 2B:
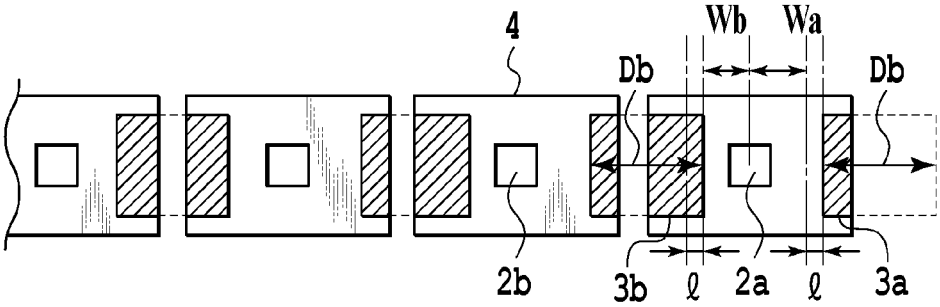
Figure 2C:
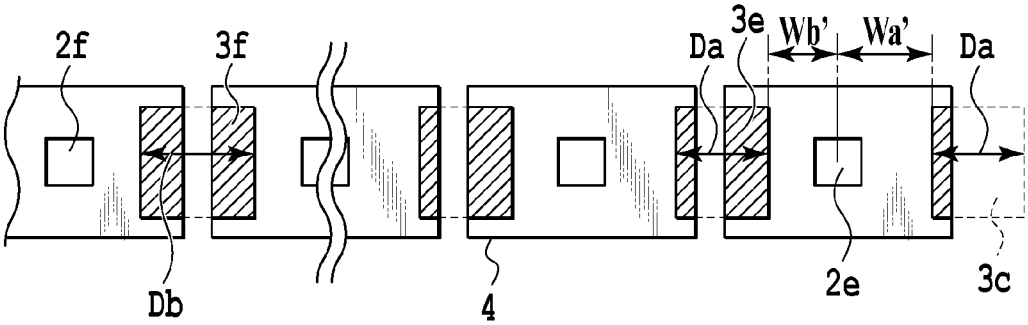

FIG. 2A is a cross section taken along a dotted line portion IIA-IIA in FIG. 1B, and is a cross section of an inkjet printing head in a case where an opening position of the ink supply opening deviates closer to the substrate end. FIG. 2B is an enlarged diagram showing conventional ejection openings at the substrate end. FIG. 2C is an enlarged diagram showing ejection openings at the substrate end in the present embodiment.

By referring to FIG. 2A, ejection openings 9 are formed on the substrate 1 by an orifice plate 5. Ink flows through ink supply openings 3 penetrating the substrate from a common liquid chamber 7 to be supplied into a pressure chamber 4. A heat resistive element group corresponding to the ejection opening group 8*a* positioned at the end of the substrate shown in FIG. 1A is defined as heat resistive elements 2*e*, and an ink supply opening group corresponding thereto is defined as ink supply openings 3*e*. A heat resistive element group corresponding to the ejection opening group 8*b* positioned at the central section of the substrate is defined as heat resistive elements 2*f*, and an ink supply opening group corresponding thereto is defined as ink supply openings 3*f*.

In the substrate of the present embodiment, the ink supply opening is etched with an angle due to an influence of an inclined surface 6 in the recessed portion, and therefore the opening position of the ink supply opening deviates closer to the end. In this case, in the conventional substrate, as shown in FIG. 2B, an ink supply opening 3*a* formed in a direction closer to the substrate end than the heat resistive element has a longer distance from the heat resistive element. On the other hand, an ink supply opening 3*b* formed in a central direction of the ejection opening row has a shorter distance from the heat resistive element.

Ink flows through the ink supply opening 3 penetrating the substrate from the common liquid chamber 7 to be filled in the pressure chamber. Therefore, as the distance from the end of the ink supply opening to the heat resistive element 2 in the pressure chamber is longer, the flow resistance which the ink receives is the larger. Therefore, a route Wb having a shorter distance to the end of the ink supply opening generates a smaller flow resistance to the ink than a route Wa having a longer distance thereto to generate a flow resistance difference between the routes Wb and Wa. Upon applying pulse current to the heat resistive element 2*a*, the ink and generated air bubbles move to be biased in the Wb direction having the smaller flow resistance because of the flow resistance difference. Accordingly, ink droplets to be ejected are ejected to be inclined in a direction of the Wb, that is, to the central section in the ejection opening row, so that the generated air bubblers develop in the Wb direction.

On the other hand, since the ink supply opening at the central section of the substrate is opened perpendicularly, a distance between the heat resistive element and the ink supply opening is constant and there occurs no flow resistance difference between the routes. Therefore, the ink droplets are ejected straight without occurrence of the bias of the bubble release in the development direction. Accordingly, in the ejection opening group 8*a* close to the substrate end, the ink is ejected to be more inclined in the central direction of the ejection opening row, and in the ejection opening group 8*b* positioned closer to the center of the substrate, the ink is ejected straight.

On the other hand, in the present embodiment, as shown in FIG. 2C, in the substrate in which the heat resistive elements and the ink supply openings are alternately arrayed one by one in the ejection opening row direction, distances between a heat resistive element at the substrate end closer to the inclined surface in the recessed portion and two ink supply openings adjacent to the heat resistive element are indicated at Wa' and Wb'. An opening width Da of the ink supply opening 3*e* in the ejection opening row direction for supplying ink to the ejection opening group 8*a* positioned closer to the inclined surface in the recessed portion is made smaller than an opening width Db of the ink supply opening in the ejection opening group 8*b* positioned closer to the center of the substrate. An opening width Da of the ink supply opening 3*c* in the ejection opening row direction is made smaller than an opening width Db of the ink supply opening in the ejection opening group 8*b* positioned closer to the center of the substrate. Thereby, the distance Wb' from the end of the ink supply opening 3*e* to the heat resistive element 2*e* is made longer, which is longer than the distance Wb between the heat resistive element 2*a* and the ink supply opening 3*a* closer to the inclined surface in the conventional substrate shown in FIG. 2B. In addition, the distance Wa' from the end of the ink supply opening 3*c* to the heat resistive element 2*e* is made longer, which is longer than the distance Wa between the heat resistive element 2*a* and the ink supply opening 3*a* closer to the inclined surface in the conventional substrate shown in FIG. 2B.

By making the distance from the end of the ink supply opening 3*e* to the heat resistive element 2*e* longer in this manner, a rate of a change in the distance between the ink supply opening and the heat resistive element due to the deviation of the opening position of the ink supply opening can be made smaller than conventional.

That is, the deviation of the ink supply opening is generated in a constant length with no relation to the distance between the ink supply opening and the heat resistive element. Therefore, in the inclined surface side of the recessed portion in the substrate, as compared to a rate (1/Wb) of an increasing amount of the distance between the end of the ink supply opening and the heat resistive element due to the deviation of the ink supply opening to the distance between the end of the ink supply opening and the heat resistive element closer to the inclined surface in the recessed portion of the heat resistive element in the conventional substrate, a rate (1/Wb') of an increasing amount of the distance between the end of the ink supply opening and the heat resistive element due to the deviation of the ink supply opening to the distance between the end of the ink supply opening and the heat resistive element closer to the inclined surface in the recessed portion of the heat resistive element in the present embodiment is made smaller. In the inclined surface side of the recessed portion in the substrate, as compared to a rate (1/Wa) of a decreasing amount of the distance between the end of the ink supply opening and the heat resistive element due to the deviation of the ink supply opening to the distance between the end of the ink supply opening and the heat resistive element closer to the center in the conventional substrate, a rate (1/Wa') of a decreasing amount of the distance between the end of the ink supply opening and the heat resistive element due to the deviation of the ink supply opening to the distance between the end of the ink supply opening and the heat resistive element in the present embodiment is made smaller.

As a result, a ratio of the distance Wa' and the distance Wb' between the ink supply opening and the heat resistive element in the present embodiment is smaller than a ratio of the distance Wa and the distance Wb between the ink supply opening and the heat resistive element in the conventional substrate. Therefore, a difference between the resistance between the heat resistive element 2*e* and the ink supply opening 3*e* and the resistance between the heat resistive element 2*e* and the ink supply opening 3*c* in the present embodiment is made smaller than a difference between the resistance between the heat resistive element 2*a* and the ink supply opening 3*b* and the resistance between the heat resistive element 2*e* and the ink supply opening 3*a* in the conventional substrate. The ink droplet ejected from the ejection supply opening at the substrate end in the present embodiment is ejected with a smaller inclination than the ink droplet ejected from the ejection supply opening at the substrate end in the conventional substrate.

In this manner, when the opening width Da of the ink supply opening in the ejection opening row direction is made smaller than the opening width Db of the conventional ink supply opening at the substrate end, a difference in the flow resistance between route Wa between the ink supply opening and the heat resistive element and route Wb between the ink supply opening and the heat resistive element can be small. As the flow resistance difference is made small, a bias in transfer of the ink flow generated at the heating of the heat resistive element is made small in the transfer direction, causing the ink droplet to be ejected in the more perpendicular direction.

Figure 3:
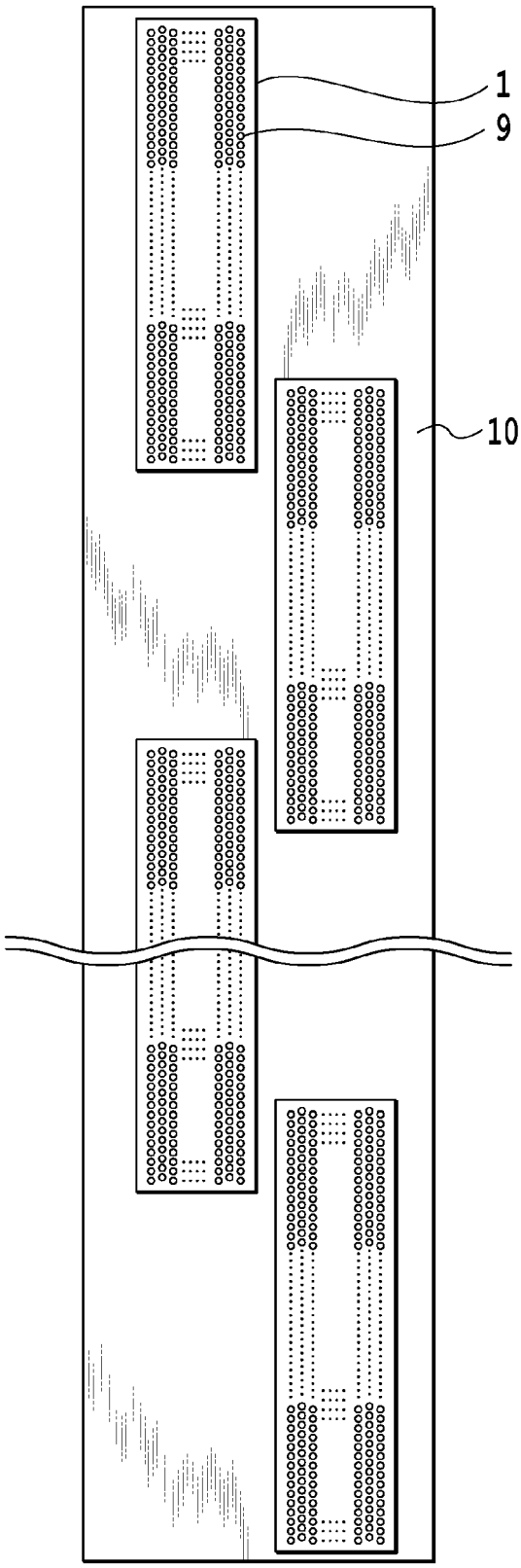
FIG. 3 is a diagram showing an example of a printing head according to the first embodiment.

On the other hand, when the distance between the end of the ink supply opening and the heat resistive element is made long and thereby the flow resistance from the end of the ink supply opening to the heat resistive element is increased, the time required for ink to refill the pressure chamber is longer. Therefore, when each distance in regard to all the ejection openings is made longer, the drive frequency of the head is required to be lowered, possibly interrupting high-speed printing. However, when the distance is made long only in the ejection opening group at the substrate end, the printing can be performed with the drive frequency matching up to the ejection opening group closer to the center of the substrate upon performing the printing in no use of the ejection opening at the substrate end. Accordingly since the drive frequency is required to be lowered only in a case of using the ejection opening group at the substrate end, a printing speed can be increased more than in a case of regularly lowering the drive frequency to perform the printing FIG. 3 is a plan view showing a printing head using a substrate in the present embodiment. In the printing head shown in FIG. 3, a plurality of inkjet printing head substrates are arranged in a zigzag manner along a predetermined direction, and arranged to overlap with each other in the array direction thereof. In such a head, the ejection opening number of the ejection openings at the substrate ends corresponding to a connecting part to the adjacent substrates increases. Therefore the individual ejection opening at the substrate end can achieve a desired striking amount with the ejection number less than the ejection opening closer to the center of the substrate. As a result, there are some cases where the drive frequency as high as that of the ejection opening group closer to the center of the substrate is not necessary in the ejection opening group itself at the substrate end. Since connection irregularities are possibly generated in a printing product due to any deviation of the landing position in the connecting part, the substrate according to the present embodiment is used to improve straightness of the ejection opening at the substrate end, thereby making it possible to produce a printing product with high quality.

(Modification of First Embodiment)

Figure 4:
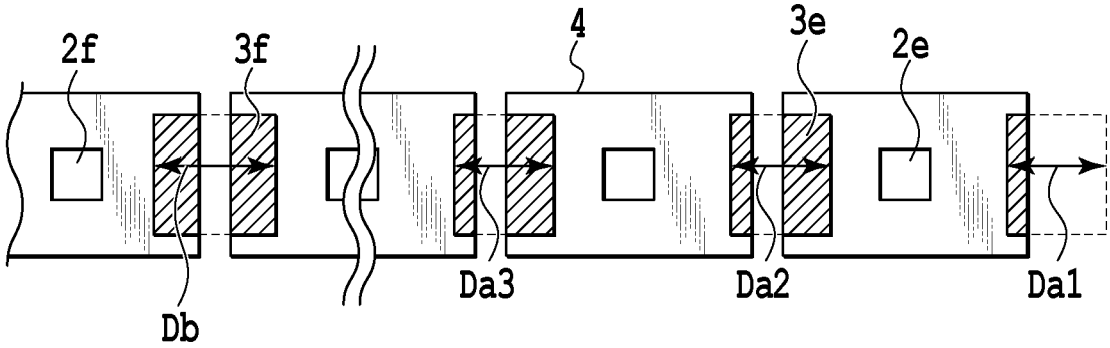
FIG. 4 is a diagram showing a modification of the substrate according to the first embodiment.

FIG. 4 is a schematic diagram showing a substrate end according to the present modification. A deviation of an opening position of an ink supply opening is the larger as the ink supply opening is in a position closer to the substrate end. Therefore the heat resistive element and the ink supply opening may be arranged with gradation in such a manner that as the heat resistive element and the ink supply opening are positioned to be closer to the substrate end, a distance between the heat resistive element and the end of the ink supply opening is the larger.

In the present modification, the ink supply openings are arranged such that an opening size of the ink supply opening along a direction of the ejection opening row at the most outer end is minimized and the opening size of the ink supply opening is the larger as the ink supply opening is closer in position to the center in the ejection opening row. That is, the ink supply openings are arranged such that a relation of an opening Da1, which is closer to the most outer end, <Da2<Da3<Db is established.

(Second Embodiment)

Figure 5:
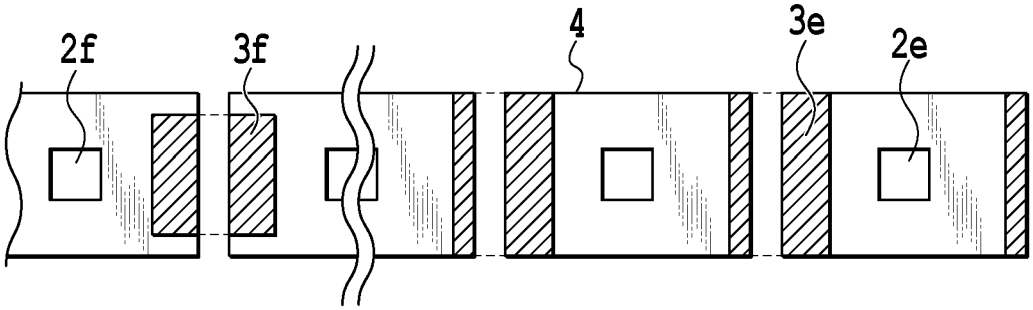
FIG. 5 is a diagram showing a substrate according to a second embodiment.

FIG. 5 is an enlarged diagram showing the ejection opening group 8*a* at the substrate end according to the present embodiment. In the first embodiment, the opening width of the ink supply opening 3*e* in the ejection opening row direction in the ejection opening group 8*a* at the substrate end is made small to reduce a rate in a change of the flow resistance due to the deviation of the ink supply opening.

In this case, since the opening area of the ink supply opening becomes small, the flow resistance of the ink supply opening increases. In a case where the time required for filling ink from the ink supply opening into the pressure chamber is constrained, there are some cases where the ejection opening group 8*a* at the substrate end is driven with a lowered drive frequency to make it in time to the ink filling time.

Therefore, in the present embodiment, the opening width of the ink supply opening 3*e* in a direction perpendicular to the ejection opening row is broadened to increase the opening area of the ink supply opening. Thereby the filling time of ink into the pressure chamber is shortened.

In the substrate shown in FIG. 5, the ink supply opening 8*e* in the ejection opening group 8*a* has a dimension of 30 μm in the array direction and a dimension of 50 μm in a direction perpendicular to the array direction, and thereby an opening area thereof is generally the same as an opening dimension of 41 μm×37 μm of the ink supply opening 3*f* in the ejection opening group 8*b*.

Therefore, the filling time difference into the pressure chamber by the flow resistance difference between the ink supply openings can be shortened to drive the ejection opening group 8*a* with the drive frequency equivalent to that of the ejection opening group 8*b*. As a result, since the ejection opening group can be regularly driven with a high frequency, high-speed printing can be performed.

(Third Embodiment)

Figure 6A:
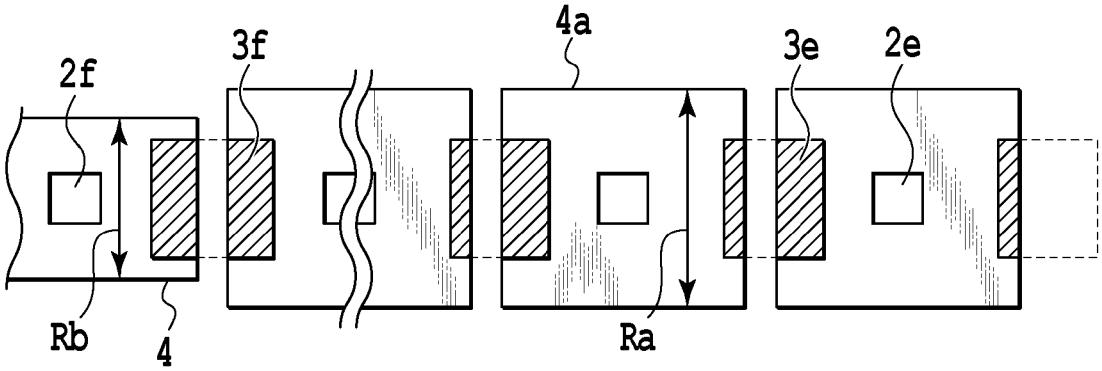
FIG. 6A and FIG. 6B are diagrams each showing a substrate according to a third embodiment.
Figure 6B:
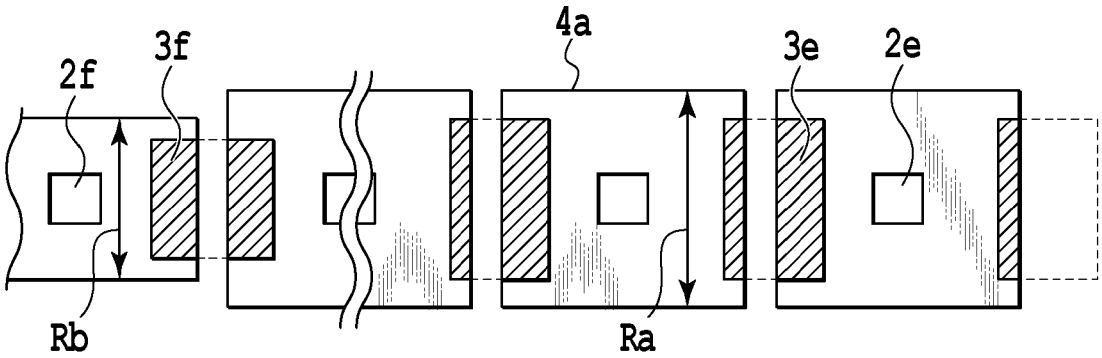

FIG. 6A and FIG. 6B are enlarged diagrams each showing the ejection opening group 8*a* at the substrate end in the present embodiment. In the first and second embodiments, the opening width of the ink supply opening 3*e* in the ejection opening group 8*a* at the substrate end is made small in the ejection opening row direction, and thereby the rate of the change in the flow resistance due to the deviation of the ink supply opening is made small.

In this case, when the distance between the heat resistive element and the end of the ink supply opening is made long, the flow resistance from the end of the ink supply opening to the heat resistive element is large, and therefore the flow resistance of the ink in the pressure chamber differs between the ejection opening group 8*a* and the ejection opening group 8*b*. As the flow resistance in the pressure chamber becomes high, since the pressure at the time of ejecting the ink has more concentration in the ejection opening direction, a flying speed of the ejected ink droplet possibly increases.

As a result, in the ejection opening groups 8*a* and 8*b*, the flying speed of the ink droplet in the ejection opening group 8*a* is faster than that of the ejection opening group 8*b* to produce a time difference in the landing of the ink droplet on a sheet between the ejection opening group 8*a* and the ejection opening group 8*b*, possibly degrading an image.

Therefore, in the present embodiment, as shown in FIG. 6A, a dimension Ra of a pressure chamber 4*a* in the ejection opening group 8*a* is made wider in a direction perpendicular to the ejection opening row than a dimension Rb of the pressure chamber 4 in the ejection opening group 8*b* in a direction perpendicular to the ejection opening row, thereby lowering the flow resistance of the ink. As a result, a difference in the flying speed of the ink droplet between the ejection opening group 8*a* and the ejection opening group 8*b* does not occur.

Further, as shown in FIG. 6B, the opening width of the ink supply opening 3*e* shown in the second embodiment in a direction perpendicular to the ejection opening row is made wider to increase the opening area of the ink supply opening and also make the dimension Ra of the pressure chamber 4*a* in the ejection opening group 8*a* wider than the dimension Rb of the pressure chamber 4 in the ejection opening group 8*b*.

That is, the substrate shown in FIG. 6B is structured such that the ink filling time difference into the pressure chamber and the flying speed difference of the ink droplet are reduced. As a result, the high-speed printing can be performed and the printing of reducing degradation of the image due to the landing time difference of the ink droplet can be performed.

(Fourth Embodiment)

Figure 7A:
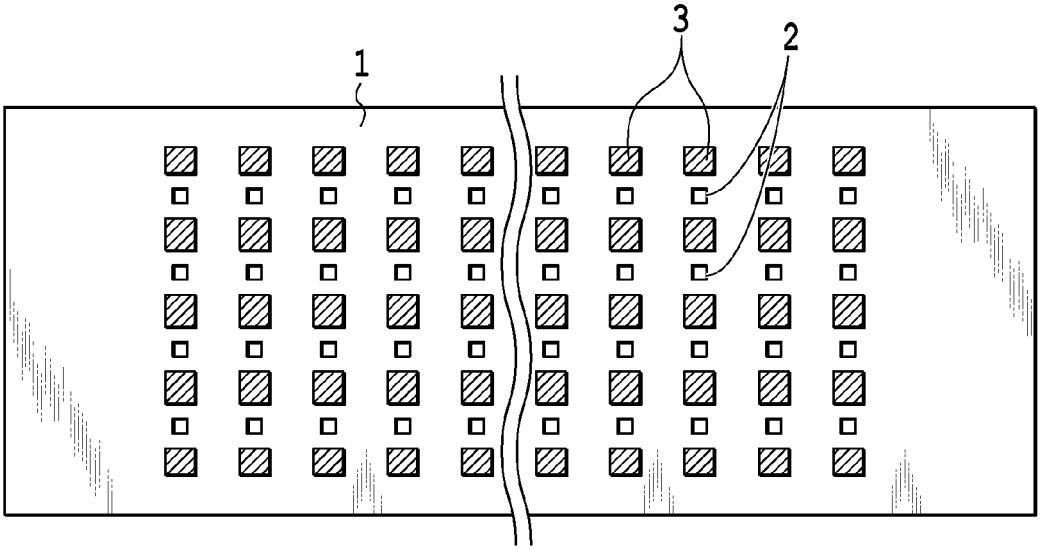
FIG. 7A and FIG. 7B are diagrams each showing a substrate according to a fourth embodiment.
Figure 7B:
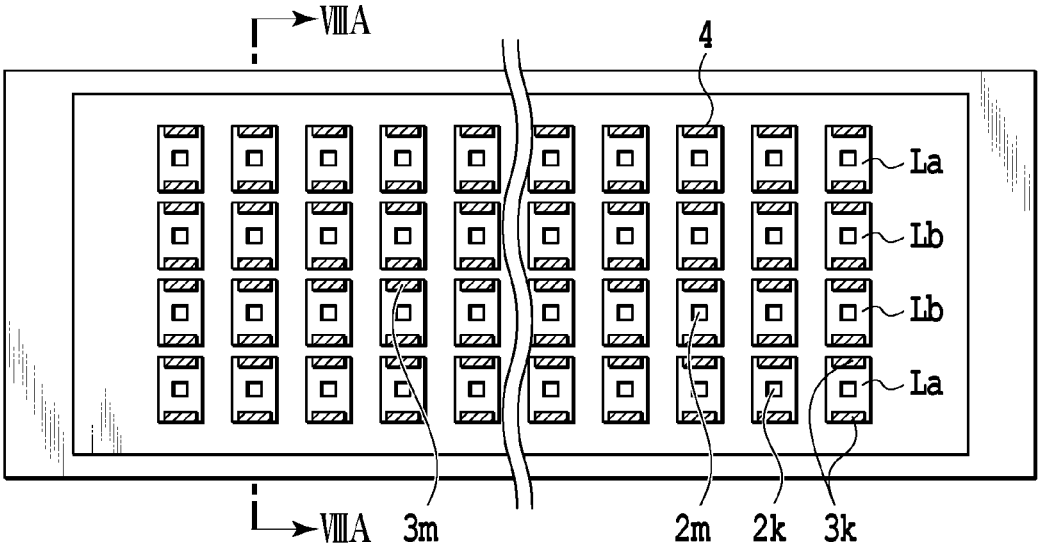
Figure 8A:
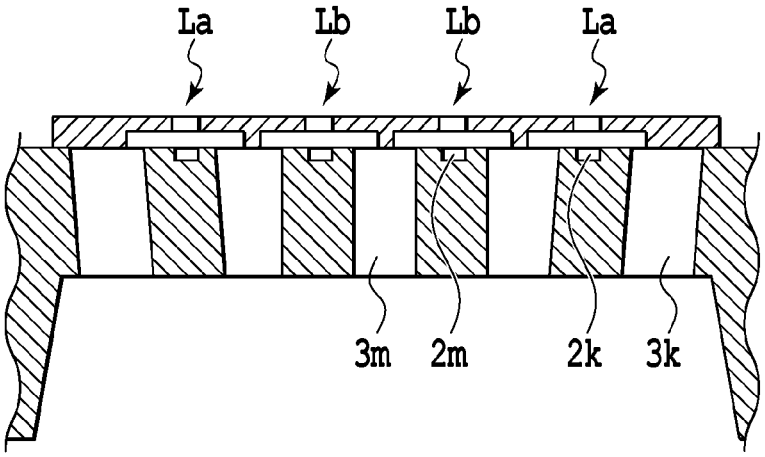
FIG. 8A to FIG. 8C are diagrams each showing the substrate according to the fourth embodiment.
Figure 8B:
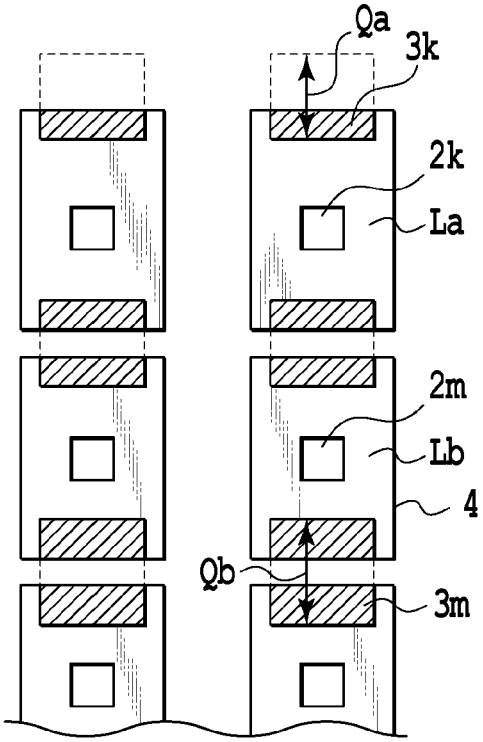
Figure 8C:
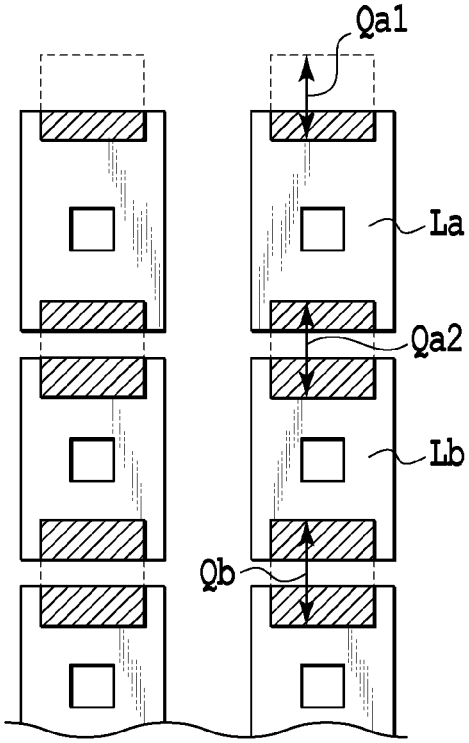

FIG. 7A, FIG. 7B, and FIG. 8A to FIG. 8C are diagrams each showing a substrate according to the present embodiment. FIG. 7A is a plan view of a substrate surface, and FIG. 7B is a plan view of the substrate with an orifice plate removed. FIG. 8A is a cross section taken along a dotted line portion VIIIA-VIIIA in FIG. 7B, and FIG. 8B and FIG. 8C are enlarged diagrams each showing the ejection opening row La and the ejection opening row Lb in FIG. 7B.

As shown in FIG. 7A, the plural heat resistive elements 2 are arrayed in a direction perpendicular to the ejection opening row, and the ink supply openings 3 are arrayed between the heat resistive elements to be adjacent to the heat resistive elements.

In FIG. 8A and FIG. 8B, a heat resistive element is indicated at 2*k* and an ink supply opening is indicated at 3*k* in the ejection opening row La, and a heat resistive element is indicated at 2*m* and an ink supply opening is indicated at 3*m* in the ejection opening row Lb. An opening width Qa of the ink supply opening 3*k* in a direction perpendicular to the ejection opening row is made smaller than an opening width Qb of the ink supply opening 3*m* in a direction perpendicular to the ejection opening row. Therefore the heat resistive element and the ink supply opening are arranged in such a manner that a distance from the end of the ink supply opening 3*k* to the heat resistive element 2*k* is made long and longer than a distance between the heat resistive element 2*m* and the ink supply opening 3*m*.

By making the distance from the end of the ink supply opening to the heat resistive element in the ejection opening row close to the substrate end longer, a rate of a change in the distance between the end of the ink supply opening and the heat resistive element due to occurrence of the deviation of the opening position of the ink supply opening can be made small. As a result, a rate of a change in the flow resistance can be also made small and the ink droplet can be ejected in a relatively perpendicular direction to prevent degradation of an image.

In addition, the deviation of the opening position of the ink supply opening is the larger as the ink supply opening is in a position closer to the substrate end. Therefore, as shown in FIG. 8C, it is more preferable that the ink supply openings are arranged with gradation in such a manner that as the ink supply opening is positioned to be closer to the substrate end, a distance between the heat resistive element and the end of the ink supply opening is the larger. In the substrate shown in FIG. 8C, the ink supply openings are arranged such that an opening size of the ink supply opening in a direction perpendicular to the ejection opening row at the most outer end is minimized and the opening size of the ink supply opening is the larger as the ink supply opening is closer in position to the center in the ejection opening row. That is, the ink supply openings are arranged such that a relation of an opening Qa1, which is closer to the most outer end, <Qa2<Qb is established.

(Fifth Embodiment)

Figure 9A:
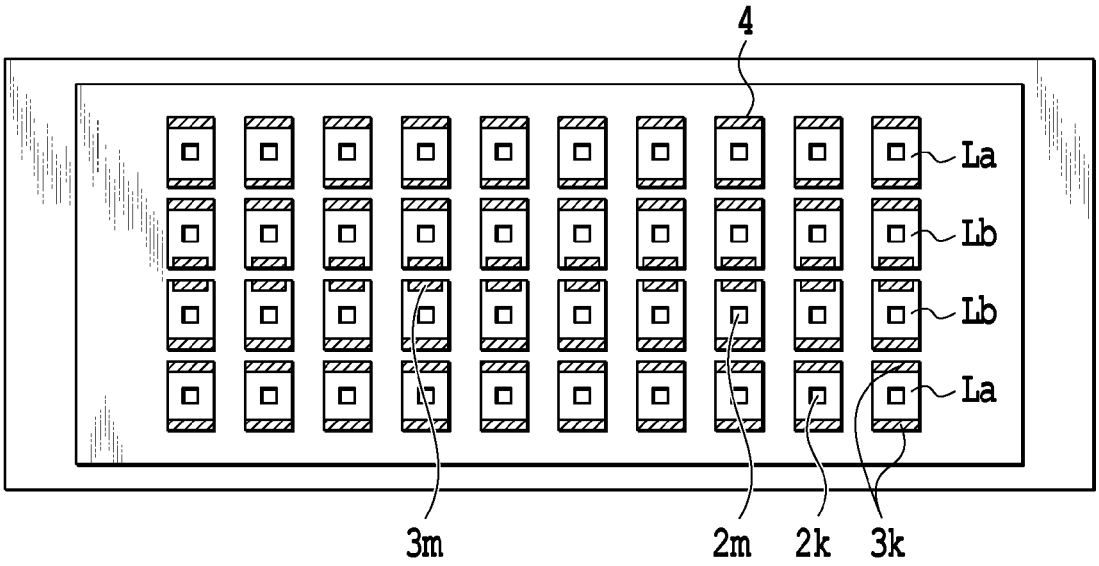
FIG. 9A and FIG. 9B are diagrams each showing a substrate according to a fifth embodiment.
Figure 9B:
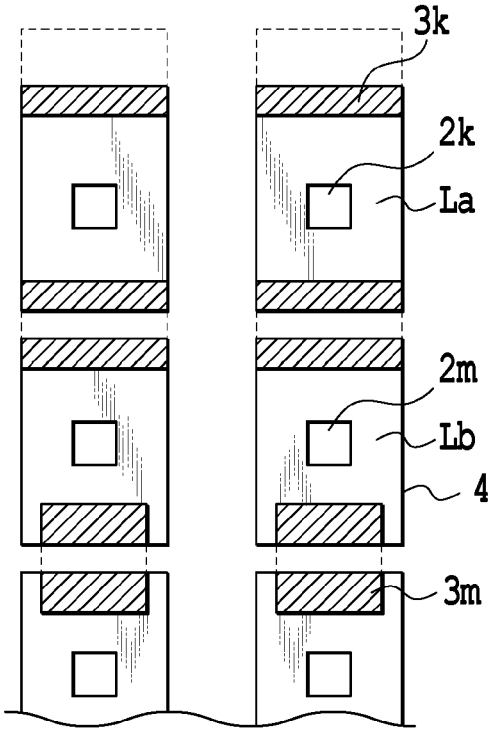

FIG. 9A and FIG. 9B are diagrams each showing a substrate according to the present embodiment. FIG. 9A is a plan view showing a substrate surface with an orifice plate in the substrate in the present embodiment removed, and FIG. 9B is an enlarged view showing an ejection opening row La and an ejection opening row Lb.

In the fourth embodiment, the opening width of the ink supply opening 3*k* at the substrate end in a direction perpendicular to the ejection opening row is made small and thereby the distance between the heat resistive element and the end of the ink supply opening is made long. Therefore, the opening area of the ink supply opening becomes small, and the flow resistance of the ink supply opening increases. In a case where the time required for filling ink from the ink supply opening into the pressure chamber is constrained by the flow resistance of the ink supply opening, there are some cases where the ejection opening row at the substrate end is required to be driven with a lowered drive frequency to make it in time to the ink filling time.

Therefore, in the present embodiment, the opening width of the ink supply opening 3*k* in a direction perpendicular to the ejection supply opening is broadened to increase the opening area of the ink supply opening. Thereby the filling time of ink into the pressure chamber is shortened. Therefore, the filling time difference into the pressure chamber by the flow resistance difference between the ink supply openings can be shortened, and the ejection opening row La can be also driven with the drive frequency equivalent to that of the ejection opening row Lb. As a result, since the ejection opening row can be regularly driven with a high drive frequency, high-speed printing can be performed.

(Sixth Embodiment)

Figure 10A:
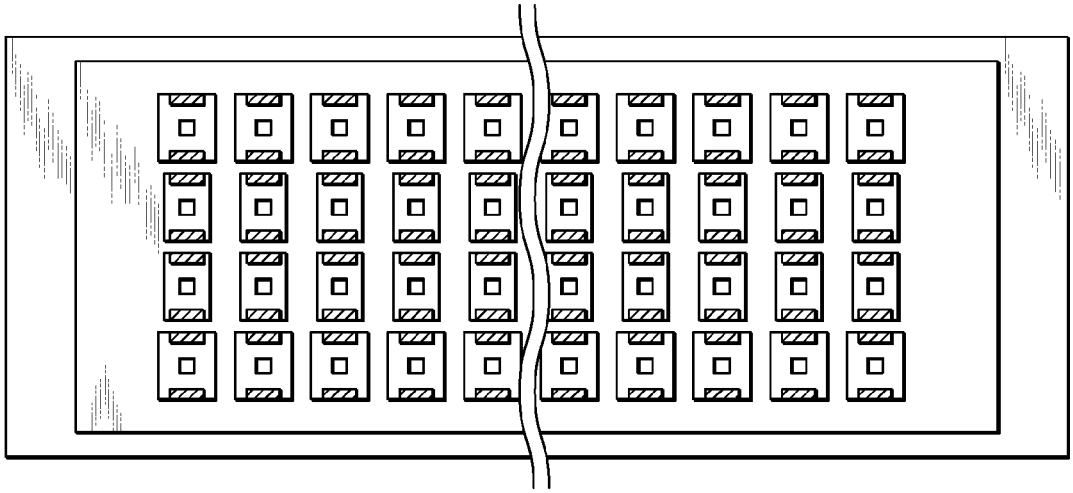
FIG. 10A to FIG. 10C are diagrams each showing a substrate according to a sixth embodiment.
Figure 10B:
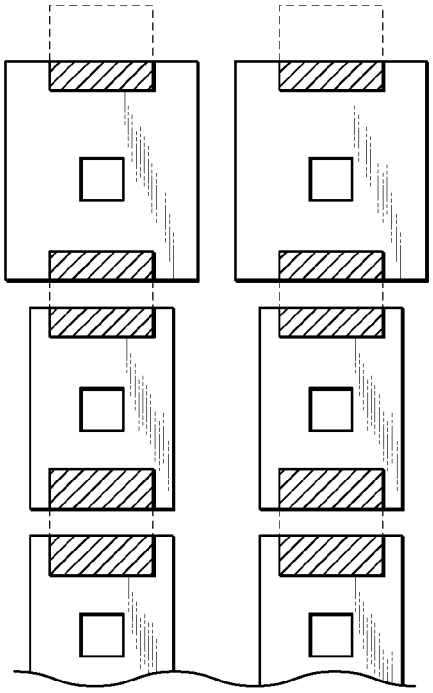
Figure 10C:
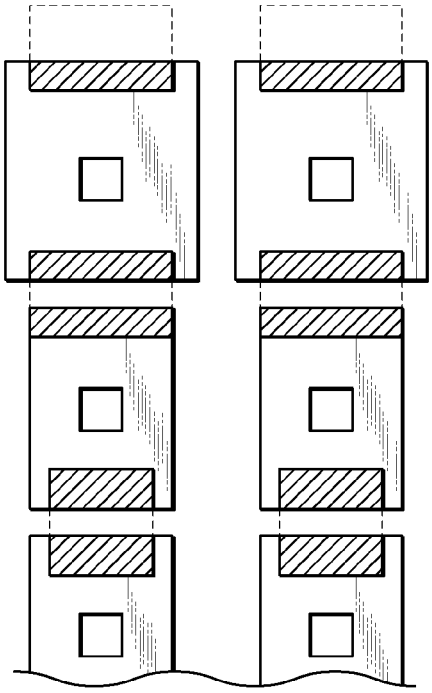

FIG. 10A to FIG. 10C are diagrams each showing a substrate in the present embodiment.

In FIG. 10A, as similar to the first and second embodiments, the opening width of the ink supply opening 3*k* at the substrate end in a direction perpendicular to the ejection opening row is made small in the ejection opening row direction, and thereby the distance between the heat resistive element and the end of the ink supply opening is made long. When the distance between the heat resistive element and the end of the ink supply opening is made long, the flow resistance from the end of the ink supply opening to the heat resistive element is large, and therefore the flow resistance of the ink in the pressure chamber differs between the ejection opening row La and the ejection opening row Lb. As the flow resistance in the pressure chamber becomes high, since the pressure at the time of ejecting the ink has more concentration in the ejection opening direction, there are some cases where a flying speed of the ejected ink droplet increases. As a result, the flying speed of the ink droplet in the ejection opening row La is faster than that of the ejection opening row Lb to produce a time difference in the landing of the ink droplet on a sheet between the ejection opening row La and the ejection opening row Lb, possibly degrading an image. Therefore, in the present embodiment, a dimension of the pressure chamber 4*k* in the ejection opening row La is broadened in a direction along the ejection opening row to lower the flow resistance of the ink, thus preventing the difference in the flying speed of the ink droplet between the ejection opening row La and the ejection opening row Lb from occurring.

In addition, as shown in FIG. 10C, the feature of the substrate in the fifth embodiment can be combined with the feature of the substrate in the present embodiment to reduce the ink filling time difference into the pressure chamber and the flying speed difference of the ink droplet. As a result, the high-speed printing can be performed and the printing in a high speed and with high quality, which suppresses degradation of an image due to the landing time difference of the ink droplet, can be performed.

(Other)

The inkjet printing head substrate according to the present invention is used in an inkjet printing apparatus for printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-090854, filed Apr. 15, 2011, which is hereby incorporated by reference herein in its entirety.

What is claimed is:

1. An inkjet printing head substrate comprising:

a first surface, a second surface, which is the backside of the first surface, on which a plurality of heat resistive elements are arrayed for ejecting ink, a recessed portion formed in the first surface, and a plurality of ink supply openings that are formed inside the recessed portion and pass through said inkjet printing head substrate, wherein in the second surface, the heat resistive elements and the ink supply openings are alternately arrayed in a predetermined direction to form an array, and a sum of respective distances along the predetermined direction between a heat resistive element located on an end side of the array and each of two ink supply openings, which are located adjacent to and at both sides of the heat resistive element located on the end side of the array, is greater than a sum of respective distances between a heat resistive element located in a central section of the array in the predetermined direction and each of two ink supply openings, which are located adjacent to and at both sides of the heat resistive element located in the central section of the array.

2. The inkjet printing head substrate according to claim 1, wherein the plurality of ink supply openings are arranged such that, as an ink supply opening is in a position closer to an inclined surface of the recessed portion in the inkjet printing head substrate, a distance between an end of the ink supply opening and a heat resistive element is made longer.

3. The inkjet printing head substrate according to claim 1, wherein each distance from the ends of the plurality of the ink supply openings formed at a distance close to an inclined surface of the recessed portion in the inkjet printing head substrate to a heat resistive element shortens an opening width of the ink supply opening in a direction of the heat resistive element.

4. The inkjet printing head substrate according to claim 1, wherein the heat resistive elements are adjacent to the ink supply openings in an ejection opening row direction.

5. The inkjet printing head substrate according to claim 1, wherein the heat resistive elements are adjacent to the ink supply openings in a direction perpendicular to an ejection opening row.

6. The inkjet printing head substrate according to claim 4, wherein the ink supply opening in an ejection opening group positioned at an end in the ejection opening row direction has an opening width in a direction perpendicular to the ejection opening row direction, which is larger than an opening width of the ink supply opening in an ejection opening group positioned closer to the center in the ejection opening row direction, in a direction perpendicular to the ejection opening row direction.

7. The inkjet printing head substrate according to claim 4, wherein a pressure chamber in an ejection opening group positioned at an end in the ejection opening row direction has a dimension in a direction along the ejection opening row direction, which is larger than a dimension of a pressure chamber in an ejection opening group positioned closer to the center in the ejection opening row direction, in a direction along the ejection opening row direction.

8. The inkjet printing head substrate according to claim 5, wherein the ink supply opening in each of the ejection opening rows arranged in positions close to the substrate end has an opening width in a direction along the ejection opening row direction, which is larger than an opening width of the ink supply opening in each of the ejection opening rows arranged closer to the center in the substrate, in a direction along the ejection opening row.

9. The inkjet printing head substrate according to claim 5, wherein a pressure chamber of each of a plurality of ejection opening rows arranged in positions close to the substrate end has a dimension in a direction perpendicular to the ejection opening row, which is larger than a dimension of a pressure chamber of each of ejection opening rows arranged closer to the center in the substrate, in a direction perpendicular to the ejection opening row.

10. An inkjet printing head comprising:

the inkjet printing head substrate according to claim 1.

11. An inkjet printing head comprising:

a plurality of inkjet printing head substrates, where each of the plurality is the inkjet printing head substrate according to claim 1, arranged in a zigzag manner along a predetermined direction, wherein each inkjet printing head substrate is arranged in such a manner as to overlap an inkjet printing head substrate adjacent thereto at the end in a direction perpendicular to the array direction.

12. An inkjet printing apparatus comprising:

the inkjet printing head according to claim 10.

13. The inkjet printing head substrate according to claim 1, wherein the plurality of ink supply openings is formed by dry-etching.

14. The inkjet printing head substrate according to claim 1, wherein a length of the heat resistive element along the predetermined direction, which is located on the end side of the array, is smaller than a length of the heat resistive element along the predetermined direction, which is located on the center side of the array.

* * * * *